United States Patent [19]

Border et al.

[11] 4,040,332

[45] Aug. 9, 1977

[54] VARIABLE SPRING RATE EQUILIBRATORS

[75] Inventors: Robert O. Border, Bettendorf, Iowa; Ronald H. Rudman, Chatsworth, Calif.

[73] Assignee: The United States Government as represented by the Secretary of the Army, Washington, D.C.

[21] Appl. No.: 689,322

[22] Filed: May 24, 1976

[51] Int. Cl.[2] ..... F41F 21/16

[52] U.S. Cl. ..... 89/37 F

[58] Field of Search ..... 89/37 R, 37 A, 37 F

[56] References Cited

U.S. PATENT DOCUMENTS

| | | | |
|---|---|---|---|
| 1,460,420 | 7/1923 | Joyce | 89/37 F |
| 1,577,529 | 3/1926 | Joyce | 89/37 F |

FOREIGN PATENT DOCUMENTS

| | | | |
|---|---|---|---|
| 30,057 of | 1912 | United Kingdom | 89/37 F |

*Primary Examiner*—Stephen C. Bentley

*Attorney, Agent, or Firm*—Nathan Edelberg; Harold H. Card, Jr.; Robert O. Richardson

[57] ABSTRACT

Artillery weapon equilibrator assemblies comprising a plurality of coaxially aligned springs, the individual load response rate of which is programmed so that the cumulative load response rate of the plurality of springs simulates a curvilinear force supply curve corresponding substantially to the curvilinear load demand curve of the weapon's tipping parts which includes the gun tube to compensate for force load changes caused by variations in the position of the center of mass of the tipping parts at any degree of elevation throughout the full range of elevation and depression of the tipping parts.

3 Claims, 4 Drawing Figures

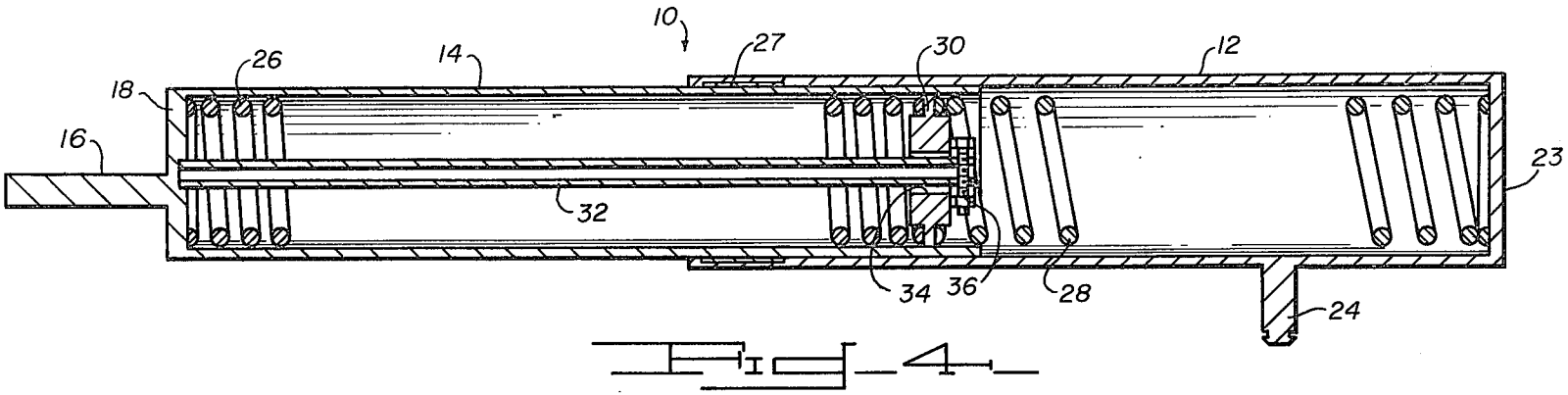
23
24
12
28
36
30
34
27
10
32
14
26
18
16
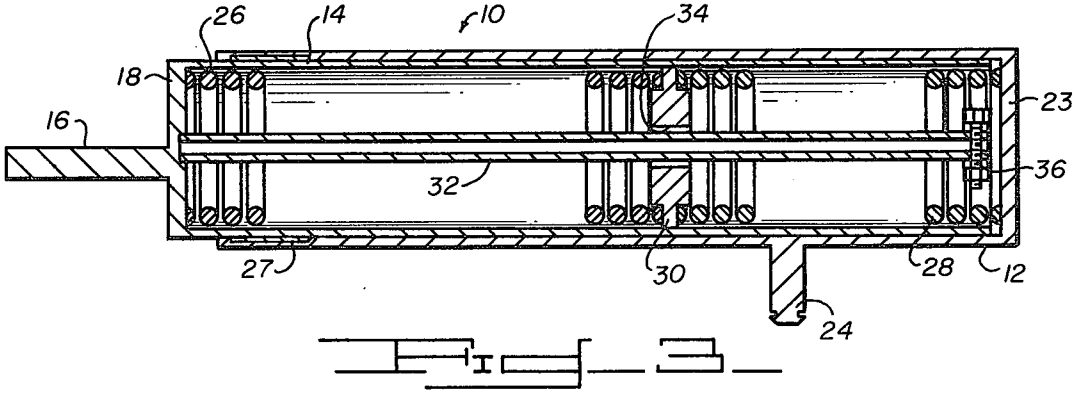
23
36
12
28
24
34
30
10
32
14
27
26
18
16

VARIABLE SPRING RATE EQUILIBRATORS

BACKGROUND OF THE INVENTION

The invention described herein may be manufactured and/or used by or for the Government for governmental purposes without the payment of any royalty thereon.

In the design of some artillery weapons, the tipping parts, i.e., those parts that pivot in elevation and depression, are located forward of the trunnions with the result being that the center of mass of the tipping parts are considerably forward of the pivot point or trunnion throughout the gun tube range of elevation.

The positioning of these parts also produces a shifting of the center of mass of the tipping parts throughout the gun elevation positions and predominately throughout the lower range of degrees of elevation. The inequality and shifting in the center of mass imposes a depressing effect on the tipping parts which presents a problem of weapon accuracy. This shifting also results in undue strain correction requirements being imposed on the gun elevating mechanism, such as a servomotor, when located near the trunnions and, consequently, variations in the load requirements imposed on the tipping parts elevating mechanism, whether manually or by power means.

In the prior art, spring equilibrators have been employed in attempts to exert a compensating or counterbalancing force on the tipping parts. Idealistically the force exerted by the equilibrators should be equal and opposite to that produced by the varying unbalanced gravity load imposed on the tipping parts at each degree of elevation in its range of elevations so that thereby the servomotor or manual load requirements will be constant and minimized. The counterbalancing forces of the spring equilibrator are functions of the spring forces and equilibrator kinematics. The supply response curve can be made exactly equal to the demand curve by adjusting the equilibrator kinematics, however design considerations preclude this in some systems.

Thus, the prior art spring actuated equilibrator assemblies relied heavily on the kinematics of the equilibrators for balancing. This new equilibration configuration allows for balancing of the demand response by varying the properties of a set of springs rather than the kinematics of the equilibrator.

SUMMARY OF THE INVENTION

These and other problems, difficulties and disadvantages of the prior art are substantially overcome by utilization of the present invention comprising a pair of equilibrator assemblies, each having a telescoping housing, a plurality of axially aligned precalibrated compression springs in the housing separated by a floating piston, and a stop rod fixedly carried in the housing to limit movement in one direction of the floating piston and one of the springs, when the tipping parts reach a predetermined angle of elevation from the horizontal.

In accordance with the present invention, the first compression spring is programmed to have a load response characteristic greater than the load response characteristic programmed for the second compression spring and in such a manner that the combined load response characteristic of the two springs represents a force-elevation load supply curve substantially equal to the force-elevation load demand curve of the tipping parts, throughout the full range of elevation and depression of the tipping parts. The springs compensate for the effects of gravity which tend to depress the tipping parts from the desired angle of elevation.

DESCRIPTION OF THE DRAWING

These and other features, objects and advantages of the present invention will become readily apparent to one skilled in the art from a reading of the following detailed description of a preferred embodiment of the present invention, when read in conjunction with the accompanying drawing, wherein like reference numerals and characters refer to like and corresponding parts throughout the several views, and wherein:

FIG. 3 is a side view in section of the equilibrator assembly of the present invention at 0° elevation of the weapon and, FIG. 4 is a view similar to FIG. 3 showing the assembly when the weapon is at 85° elevation.

DESCRIPTION OF A PREFERRED EMBODIMENT

Figure 1:
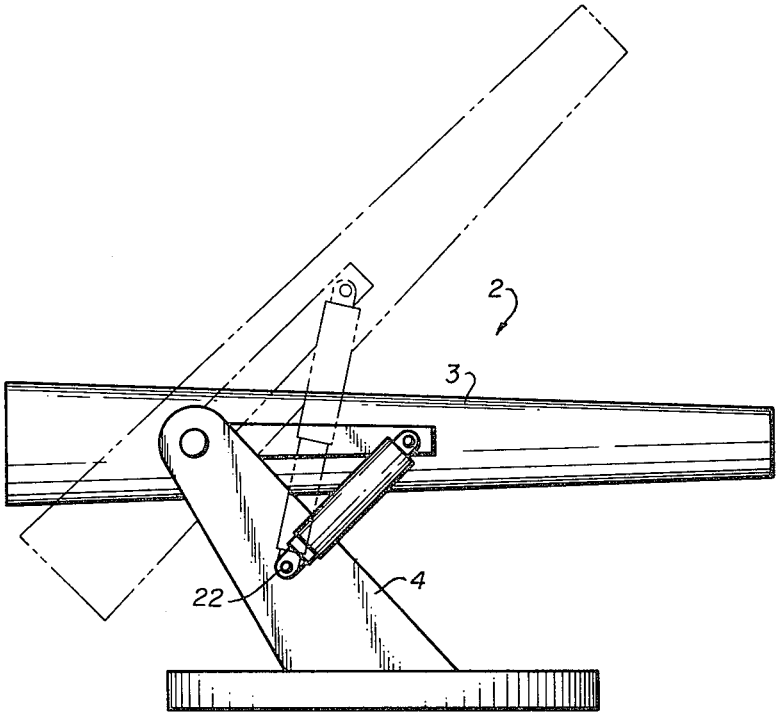
FIG. 1 is a schematic view of an artillery weapon incorporating equilibrator assemblies constructed in accordance with the present invention.
Figure 2:
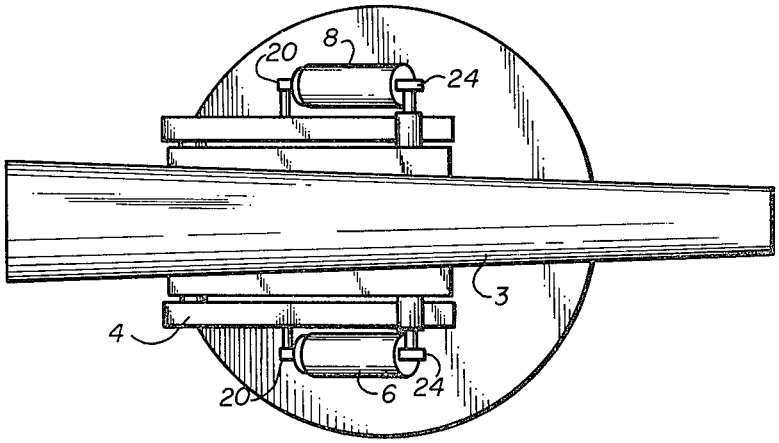
FIG. 2 is a top view of the weapon of FIG. 1.

In FIG. 1 is illustrated an artillery weapon of large caliber, generally indicated by the numeral 2, which has a tipping parts 3 pivoted to a mount 4 for movement, for example, from between 0°, as shown in full lines, to 85° as shown in dotted lines.

The weapon 2 carries a pair of equilibrator assemblies 6 and 8 constructed in accordance with the present invention, one on each side of the tipping parts. Each of the equilibrator assemblies 6 and 8 is identical in construction and operation and, thus, the following description of the structure and operation of equilibrator assembly 6 applies equally as well to equilibrator assembly 8.

The equilibrator assembly 6 (FIGS. 3 and 4) includes a two part housing 10 which has an outer cylindrical section 12 and an inner cylindrical section 14 slideably telescoped in section 12. The inner section 14 has an extension 16 protruding from its outer end wall 18 which may be bored as at 20 to receive a pivot pin 22 (FIG. 1) carried by the fixed gun mount 4.

Similarly, the outer section 12 has adjacent its end wall 23 a pivot lug 24 which is carried by the pivotable tipping parts 3. Bearing material 27 is provided to minimize the sliding friction between outer cylindrical section 12 and inner cylindrical section 14.

In housing 10 are a pair of axially aligned precalibrated compression springs 26 and 28 separated by an annular floating piston 30. The spring 26 bears at one end against the wall 18 of inner housing section 14 and at its other end against the piston 30, whereas the spring 28 bears at one end against the piston 30 and at its outer end against the wall 23 of the outer housing section 12.

Coaxial with the housing 10 is an elongated stop member 32. Stop member 32 is fixed to the end wall 18 and extends through an axial bore 34 formed in the piston 30. The stop member 32 carries an enlarged fixed head 36 which limits movement of the floating piston 30 in one direction and thus expansion of spring 26 while not interferring with movement of the piston 30 in the opposite direction or with compression and expansion of spring 26. The head 36 is also sized so as not to interfere with either compression or expansion of spring 28 in response to movement of the piston 30 towards end wall 18.

Thus, with the present invention one is capable of determining the demand curve of the tipping parts throughout the full range of elevation and depression of the weapon. Once having determined this curvilinear demand curve, the equilibrator assemblies of the present invention may then be programmed to generate collectively a load response curve equal to or approaching the demand curve requirements of the tipping parts even though the individual supply curve of each individual spring may be linear. Utilization of the floating piston and stop member 32 permit transition of the counterbalancing load of the plurality of springs of the preferred embodiment in response to changes or variations in the demand requirements of the tipping parts over their entire demand curve.

In operation, the demand curve requirements of the tipping parts throughout their full range of elevation and depression is first determined by conventional means.

A plurality of springs 26 and 28 are precalibrated at different compression rates to exhibit a combined depression spring rate approaching the demand rate of the tipping parts at low elevations when the equilibrator assemblies are compressed.

As the tipping parts are elevated and the outer housing section 12 is extended, the spring 26 is prevented at a predetermined point on the demand curve from acting in response to the demand load because the floating piston 30 is caused to contact the stop member 32. At this point, only spring 28 acts to continue responding to the demand load of the tipping parts to compensate for shifting in the center of mass of the elevating tipping parts. Thus, the equilibrator system is now operating under a different spring response rate corresponding to the changed elevation demand requirements of the tipping parts. When the tipping parts are depressed the outer housing section 12 telescopes over the inner section 14 and compresses spring 28 until the previously predetermined point of the demand curve is reached whereupon the floating piston is moved from contact with the stop 32 and spring 26 is again activated to respond compressively in cooperation with spring 28 to compensate for the increasing load demand requirements of the depressing tipping parts.

It will be appreciated that more than two coaxially aligned springs may be utilized in the operation of the present invention and that, although the individual springs each exhibit a linear supply response curve, the use of more than one spring can be employed to more nearly simulate collectively a total response curve approximating the demand curve of the tipping parts throughout its full range of elevation and depression to compensate for the depressing effects attributable to variations in the location of the center of mass of the tipping parts.

It is to be understood that, although a preferred embodiment of the present invention has been shown and described herein, the present invention is not limited thereto, because variations and other embodiments will become readily apparent to one skilled in the art from the foreging description. Accordingly, the present invention should be considered as limited only by the scope of the following claims.

We claim:

1. An equilibrator assembly for a weapon system having a set of tipping parts pivotable in elevation relative to a fixed mount including an expandible housing pivoted between the tipping parts and the mount, and a plurality of coaxially aligned spring means in the housing cooperable to expand in response to the increased elevational position of the tipping parts to compensate substantially for the weight load demands of the tipping parts caused by variation in the location of the center of mass of the tipping parts throughout its range of elevation and depression.

a floating piston interposed between two of said spring means, said housing having two sections with one section telescopically movable in the other section in response to elevation and depression of said tipping parts, and an elongated stop member carried by said housing and engageable with said floating piston to prevent further expansion of one of said spring means when the tipping parts have reached a predetermined angle of elevation, said stop member extending through a bore in the floating piston and having an enlarged head for preventing movement of said piston when the tipping parts reach a predetermined angle of elevation.

2. The assembly of claim 1 wherein the stop means prevents expansion of the spring means in the housing section pivotally connected to the mount.

3. The assembly of claim 2 wherein the housing section connected to the tipping parts is movable relative to the housing section connected to the mount.

* * * * *